United States Patent [19]

Bradbury

[11] 4,074,902

[45] Feb. 21, 1978

[54] SHEET FEEDER

[75] Inventor: Wilburn F. Bradbury, Northbrook, Ill.

[73] Assignee: Addressograph-Multigraph Corporation, Cleveland, Ohio

[21] Appl. No.: 708,053

[22] Filed: July 23, 1976

[51] Int. Cl.[2] ..... B65H 3/04

[52] U.S. Cl. ..... 271/34; 271/125; 271/167; 271/258; 271/265

[58] Field of Search ..... 271/34, 35, 265, 258, 271/259, 122, 125, 167

[56] References Cited

U.S. PATENT DOCUMENTS

| | | | |
|---|---|---|---|
| 3,108,801 | 10/1963 | Van Dalen | 271/34 X |
| 3,734,490 | 5/1973 | Parks | 271/34 |

*Primary Examiner*—Richard A. Schacher
*Attorney, Agent, or Firm*—Ray S. Pyle

[57] ABSTRACT

A combination sheet-feed and utilization machine wherein the sheet feeder comprises an endless belt, or series of belts. The belt is driven in a path which is normally out of contact with a paper sheet stack and when a sheet is to be fed, the run of the belt between end supports is distended toward the sheet stack until contact is made and frictional engagement picks up the top sheet and begins it on its feed path. A retard mechanism prevents double feeding. The feed cycle is initiated by whatever means is convenient for the particular use, such as manual feed button or a machine cycle controller requesting another master, for example. The sheet travels to the utilization device, whatever type is being supplied, and when the sheet arrives at the utilization device in-feed, it triggers a sensor to initiate a circuit which ends the paper feed cycle and begins the utilization device cycle to pick up the paper from the feeder.

2 Claims, 4 Drawing Figures

SHEET FEEDER

BACKGROUND OF THE INVENTION

Paper feed devices are legion. It is not known how early or in what form the first sheet feeders were put into operation, but a certain degree of sophistication began developing in the late 1940 era and up until the present writing.

Sheet feeding has taken on almost every conceivable means of causing one sheet to separate from a stack and to proceed into a utilization device. The flat feed from a stack into offset duplicators is one well-known illustration. A 1952 U.S. patent issued to inventor Stevenson and assigned to A. B. Dick Corporation, U.S. Pat. No. 2,585,873, is an example.

Inventors have attempted to facilitate good feeding of a single sheet without double feeding by placing the paper stack in almost every conceivable position relative to the feeding device. A vertical machine is shown by the Bell and Howell assignee, Johnson, U.S. Pat. No. 2,626,148, issued in 1953. Feeders have worked from the bottom, from the top, vertically, inclined, flat, and bowed to name some of the variations. Almost every company that has put out a machine requiring sheet feeding has developed one or more varieties. Pitney-Bowes, IBM, Xerox, and Addressograph-Multigraph Corporation are only a few examples. Vacuum feed devices have also become well-known wherein an air-flow through a picker finger causes a top sheet to be lifted off a stack and advanced over into the nip of advancing rollers. Three-M Corporation has developed and marketed a "sticky-finger" feed wherein an adhesive pad is tapped on the top sheet and thereby causes the lifting of a top sheet, in the manner of the vacuum feed.

Accordingly, developments in paper sheet feeding have now become specialized for particular applications, rather than broadly new concepts. The present invention is in the realm of belt feed devices in the general category of Kramell et al, U.S. Pat. No. 3,895,791, but more closely related to Strobel of Xerox Corporation, U.S. Pat. No. 3,934,869. Of further interest is Xerox inventor Strange, U.S. Pat. No. 3,768,803.

SUMMARY OF THE INVENTION

Although this invention employs an endless belt, and preferably a series of resilient bands, resembling the above-mentioned Xerox Corporation patents, it has the advantage of an extended longitudinal section of the belt as a frictional feed, but being in contact with the paper only when feed is desired. There is no continuous contact with the paper.

Furthermore, the manner of bringing the frictional engagement is an advantage in that contact is sure and predictable with each feed cycle.

In addition, an object of the invention and a further advantage is that the cycle of operation is an initiation of the feed device, with a utilization device bearing a cycle ending sensor for the feeder which simultaneously acts as a cycle commencing action for a utilization device.

These advantages and objects of the invention are uniquely combined to provide efficient separation of sheets from a stack and completion of the separation by a utilization device.

DESCRIPTION OF THE PREFERRED EMBODIMENT

Although reduced to practice in a commercial embodiment, the drawings are schematic in order to eliminate the non-essential detail which might otherwise confuse the proper illustration of the principles of this invention. As an example, all sheet feeding devices employ side guides which are adjustable to accommodate the width of the particular sheets being fed. Those side guides and the automatic adjustment of one side with respect to the other have been eliminated. However, the illustration is essentially that of a working embodiment which has proven successful in extensive testing.

The invention resides not only in a sheet feeding device, but the combination therewith of a utilization device which accepts a sheet from the feeder and stops the operation of the feed device at the same time it initiates the operation of a utilization device.

Figure 1:
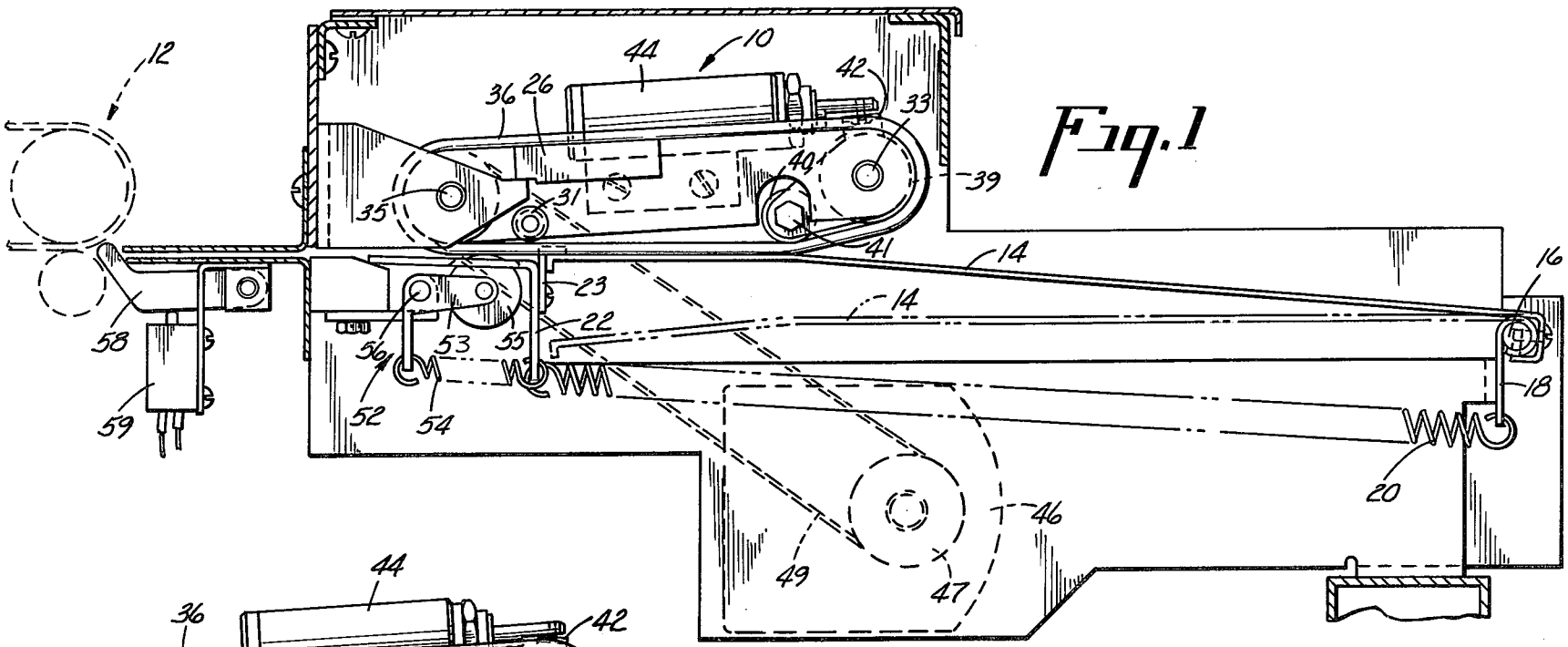
FIG. 1 is a side elevation illustration of the principle operating components of an embodiment of the sheet feeder and utilization device.

The sheet feeder is represented in general by the reference character 10 in the FIG. 1. The utilization device is indicated in general by the reference character 12. The utilization device 12, in the actual reduction to practice, is the exposure table of a photocopy machine, and copies from the feeder delivered to the device 12 are metered into the photocopier utilization device by a calculated feed rather than the arrival of the sheet at a stop device.

The sheet feeder portion has a support bed 14 upon which one or a group of documents to be supplied one by one to the utilization device 12 may be placed. Bed 14 is mounted for swinging pivotal movement on rod 16, the ends of which are rotatably mounted in the side plates. The lowermost position of the bed 14 is shown in dotted outline below the full line standby position.

The bed 14 is caused to lift the stack of paper toward the dispensing position. In order to give an upward lift to the table it is equipped with a drive crank arm 18 which is secured to the rod 16. Springs 20, only one of which is illustrated in the drawings, are attached at one end to the drive crank arm 18 and at the other end are attached to a fixed position frame 22. Frame 22 is a downward extension of a portion of the frame which serves as a bed extension. Upward limit is established by two upstop limit brackets flanking the feeder 10, one of which appears in the FIGS. 1 and 2 as member 23.

This embodiment of the invention is illustrated in a horizontal position, and therefore the reference to a position above or below is a reference to the particular embodiment illustrated. This invention is operative in positions other than the lateral flat position illustrated.

A belt drive head 26 above the bed 14 is activated to cause the top sheet positioned upon bed 14 to be advanced toward the utilization device 12. Head 26 is built between side plates 28 as seen best in FIG. 3. Also in FIG. 3 anchor support stanchions 30 support the side plates in the slightly angled position observed best in FIG. 2. A drum 32 is mounted at one end of the side frames on an axle 33 which extends between the frames. A drum 34 is mounted on an axle 35 on the opposite end of the frame plates. A plurality of resilient belts 36 are reeved around the two drums 32 and 34 to provide frictional drive when applied to sheets on the bed 14. The preferred embodiment employs a series of individual belts 36 which are round in cross section and are made of high friction resilient rubber. There are a variety of belt forms and compounds well-known in the art which may be selected. Whether one or a plurality, however, the structure described does provide an endless sheet separation belt, whether one considers an individual belt 36 or the several belts collectively. Hereafter reference will simply be made to a belt in the singular. The sheet separation belt includes a section between the drum 32 and a roller 31 which is mounted a short distance ahead of the drum 34. This section is carried in the direction of feed; and, because it has an expanse between the drum 32 and roller 31, there is a deformable, unsupported section therebetween.

Figure 2:
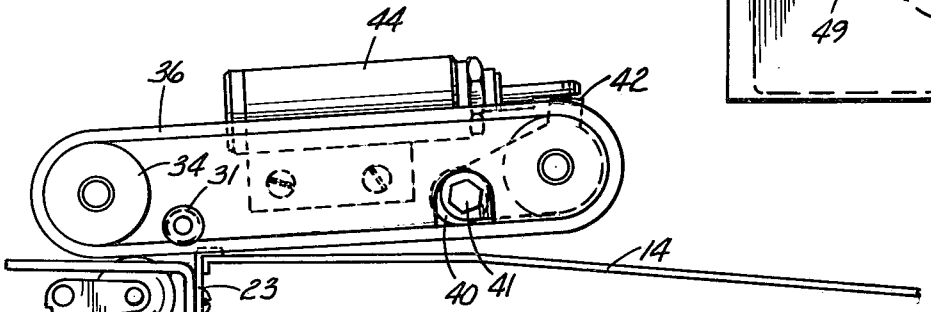
FIG. 2 illustrates the inactive condition of the belt drive of the sheet feeder.
Figure 3:
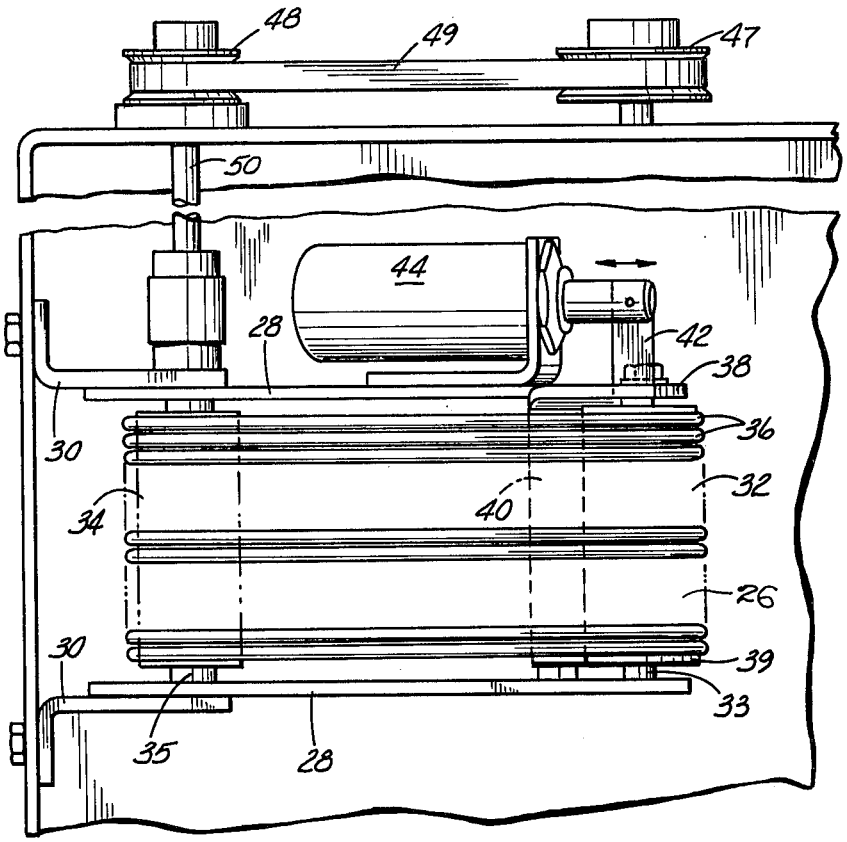
FIG. 3 is a top plan of the belt drive of the sheet feeder.

The distending of the belt from the FIG. 2 to the FIG. 1 condition is achieved by a belt distending means positioned between the first and second drums at a location in the unsupported belt section and adjacent the supply-support bed 14 for distending the belt toward the bed upon command. Physically, this is accomplished by providing a link 38 and a link 39 on opposite sides of the drum 32, as seen best in FIG. 3. A roller 40 is carried on an axle 41 mounted on the end of the two links. A drive arm 42 is connected to a solenoid 44. The solenoid, as seen in FIG. 3, has a linear movement as indicated by the arrow above the motor drive stem. The FIG. 3 illustration is in the extended position. When the solenoid 44 is activated, it will draw the drive arm 42 and cause the links 38 and 39 to force the roller 40 against the belt in order to distend the belt into the FIG. 1 position.

A main drive motor 46 operating through a pulley 47, to drive a pulley 48 by means of belt 49 will power-drive the belt drive drum 34 by means of a drive shaft 50. Hence, by activating the motor 46 and the solenoid 44, the belt 36 begins its drive movement in the direction of feed and it is distended to lie flat against any sheet supported on the bed surface 14, and thereby applies a frictional drag of a long stretch of the belt against the document to be driven forward in a feed action.

Double feeding is a problem in all feed devices. In theory, a high frictional contact with the top document, and a lesser interdocument friction will enable the top document to slide freely over the next lower document and provide a single sheet feed. In reality, the second sheet very often attempts to feed along with the top sheet. Most devices provide a retard member to cause additional retardation of the second sheet and prevent double feeding. When there are two or more sheets in the stack and the top sheet has been forwarded to the utilization device 12 for withdrawal, the motor 46 is deactivated and hence the belt is no longer power-driven. Nevertheless, the belt is in contact with the sheet which is partially dispensed, and therefore, frictional contact causes the sheet to drive the belt as the sheet is pulled from the feeder by the utilization device, and the belt is driven and continues to rotate in the direction of feed. An overrunning clutch drive to drum 34 makes this possible. When the top sheet has been pulled far enough to uncover any underlying sheet on the bed 14, the belt will then attempt to advance that next sheet also, to drive it partially into the retard nip. Frequently double sheet forwarding will result.

To obviate this shortcoming, the long drive surface of the belt is raised off the paper stack as soon as the forward sheet is grasped by the forwarding mechanism of the utilization device 12. Thus, there is little tendency for the underlying sheet to be frictionally driven forward. In FIG. 2, the upwardly angled position of the unsupported section, which essentially clears the bed 14 and does not provide drive feed for sheets on the bed, illustrates the contrast with the FIG. 1 wherein the belt is in such drive configuration.

A further advantage of the raised belt is to facilitate loading the feeder bed. The stack may be inserted all the way into the stop plate without pushing the sheet against the friction of the belt. In this embodiment of the invention, a retard member 52 is built upon a bell crank 53 which is urged by a spring 54 to force a roller 55 in the direction of the belt 36 between the roller 31 and drum 34 in the feed direction. Crank 53 is mounted on a pivot 56.

Retard members are essentially universal in single sheet feeders of this nature, located somewhere in the system. Usually they are high friction elastomeric material. There is often difficulty with such material, however, because the retard member loses its high frictional characteristic due to a glazing over by the filler material from the paper which scuffs off as the paper is dragged over the surface of the retard member. This invention provides a unique life extender for a retard roll.

The roller 55 has built into the mount thereof a one-way clutch which permits the roller to turn in the direction of the arrow only (FIG. 2). Roller 55 is of high friction rubber compound which will retard any second sheet attempting to feed with the top sheet, by pressing against the bottom sheet as it attempts to feed out with the top sheet. There is no rolling action of the roller 55.

The retard member is a novel feature of this invention in that it is rotated in slight increments in the direction of the arrow, against the direction of feed, by a unique phenomenon which takes place as the roller 40 causes the belt to distend simultaneously with, or very slightly prior to, the full speed drive of the belt by the motor 46. The distending causes the belt to stretch in the direction opposite the feed direction, and hence, drive the retard member a very slight increment in the direction which is permitted by the clutch. The amount of such drive can be controlled by balancing the time of the distention of the belt versus the time of activation of motor 46 in order that the reverse stretching will take precedence over the forward drive by a very slight moment of time.

Figure 4:
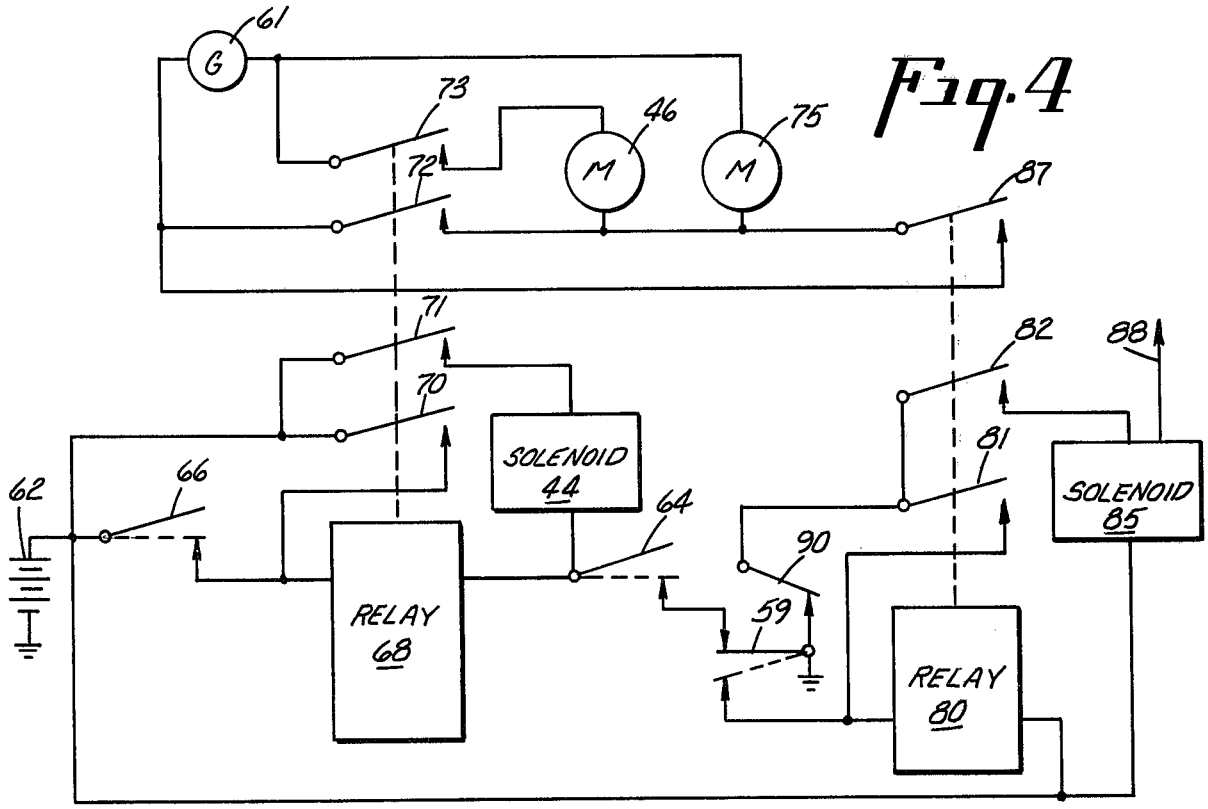
FIG. 4 is an electrical control schematic.

This application is a companion application to application Ser. No. 708,052 entitled Document Transport System filed July 12, 1976 and assigned to the assignee of this application which teaches and claims a novel utilization device 12. FIG. 4 of the drawings illustrates an electrical circuit which is described at greater length in the companion application and claimed as a portion of the complete assembly. FIG. 4 herein illustrates a control circuit which causes the commencement of a working cycle by delivering a sheet from the sheet feeder 10 and the initiation of some utilization device 12, not being specific as to the particular utilization structure.

The FIG. 4 illustrates two separate power sources, a first being a source for operating the motors and drives, and indicated by the reference character 61. The second is a battery 62 which suggests a lower voltage control energy source.

A document switch 64 is placed to sense the presence of any document placed on the support bed 14. The document switch in FIG. 4 is indicated by reference character 64 and is shown to be normally open. When a document is placed on the bed 14 the switch 64 closes.

A normally open start switch 66 is generic to any means desired to start the operation. It may be a combination of starting devices. A manual pushbutton, a program start signal, or a sensing device responsive to completion of treatment in the utilization device, are examples of means to close the circuit and begin a new cycle of operation. When the start switch 66 is closed, a circuit is completed to relay 68 to begin the document feed operation. Closing of relay 68 operates a lock circuit switch 70, a solenoid switch 71 and two motor switches 72 and 73.

Operation of relay 68 therefore sets in motion the motor 46 to drive the belts 36, and a motor 75 which drives the belt illustrated in the utilization device 12. Simultaneously, solenoid 44 causes roll 40 to be lowered to distend the belts and begin a sheet feed action.

A sheet fed from the feeder 10 advances to the sensor arm 58 of switch 59 and moves that switch from the normally open position shown in FIG. 4 to the closed dotted outline position. Closing of switch 59 energizes relay 80, closing interlock switch 81 and solenoid switch 82, thereby energizing a solenoid 85 and holding the solenoid 85 energized as long as switch 81 is closed and in circuit.

Simultaneously with closing of the switch 59, the circuit to relay 68 is broken and therefore all of the switches operated by that relay 68 are opened. Because the circuit is switched instantaneously from relay 68 to relay 80, the energy to motor 75, although disrupted through the switch 72, is transferred instantaneously through a switch 87 operated by the relay 80.

The solenoid 85 is illustrated as being in control of an apparatus through outlet line 88. The line 88 is in control of utilization device 12 and is capable of imparting a starting control in a manner which may be selected by the designer of the utilization device 12.

Furthermore, the utilization device is equipped with a sensor, a timing device, or other control which, at appropriate time, will operate a home switch 90 to break the circuit to relay 80 and cause the opening of switches 82 and 87 to cease operation of the solenoid 85 and its controlled outlet 88 as well as the motor 75 of the utilization device.

At this juncture, the apparatus has completed one cycle and may begin another operation through the means selected for operating of the switch 66.

What is claimed is:

1. A sheet feeder, comprising:

a sheet supply support bed;

a sheet separating belt means comprised of two spaced drums and at least one endless belt of high friction characteristics reeved about the drums;

first power means to drive said drums and belt in a direction to move a bottom run of said belt the direction of feed;

a document support bed extending adjacent said bottom run in an angular relationship normally out of document feed contact with said belt;

a retard roller having a one-way clutch, said roller mounted in contact with said belt between said drums, said clutch permitting rotation only in a counter-feed direction;

a pressure foot positioned within the loop of the belt between the drums with a second power means to press the belt into contact with said bed by distending the belt; and control means for distending the belt prior to full drive of the belt by said first power means to thereby stretch the belt in a reverse drive direction by a small increment prior to the belt drive and thereby increment the retard roller, whereby a fresh retard surface is brought into service with each sheet feed cycle.

2. In combination, a sheet feeder and utilization device, comprising:

a sheet supply support bed defining a lead edge sheet stack position;

a frictional retard surface fixed against motion in a sheet feed direction;

spaced first and second belt support pulleys;

power drive means for one of said pulleys;

an endless sheet separation belt reeved around said pulleys, one of said pulleys being just forward of the lead edge stack position and at a location to hold the belt in cooperative relation with said retard surface, said belt having a run normally extending at an angle from said one pulley upwardly over said stack position and out of conveying contact with sheets of a stack, and being forcibly deflectable into contact therewith;

a belt distending means positioned between said first and second pulleys at a location adjacent said deflectable belt run and opposite said supply support bed for distending said belt toward said bed upon command into a substantially parallel and congruent relationship with the orientation of said sheet supply bed;

means for moving said support bed towards said belt as a sheet stack thereon is depleted;

a feed control system having feed cycle initiating means for controlling the starting of the drive for said belt in said direction of feed and commanding operation of said belt distending means;

a sheet utilization means including a sheet forwarding means independent of said sheet separation belt for accepting and processing a delivered sheet;

a cycle terminating means responsive to a sheet delivered to a position wherein a sheet lead edge lies beyond said sheet feeder and is within the active ambit of said sheet forwarding means for stopping said power drive means and restoring the belt distending means to inactive position, whereby the fed document will advance under the influence of the sheet utilization forwarding means without causing the belt to drive a next document in the stack due to belt motion induced by friction between the fed document and the belt; and said terminating means initiating utilization means into action.

* * * * *